US008013704B2

(12) United States Patent
Kitajima et al.

(10) Patent No.: US 8,013,704 B2
(45) Date of Patent: Sep. 6, 2011

(54) COIL COMPONENT

(75) Inventors: Yoshiaki Kitajima, Tokyo (JP); Masatoshi Shindoh, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/014,432

(22) Filed: Jan. 26, 2011

(65) Prior Publication Data

US 2011/0115592 A1 May 19, 2011

Related U.S. Application Data

(63) Continuation of application No. 12/047,812, filed on Mar. 13, 2008, now Pat. No. 7,898,375.

(30) Foreign Application Priority Data

Apr. 10, 2007 (JP) ..... 2007-103096

(51) Int. Cl.
*H01F 27/02* (2006.01)
*H01F 27/29* (2006.01)
*H01F 5/00* (2006.01)

(52) U.S. Cl. ..... 336/83; 336/192; 336/200

(58) Field of Classification Search ..... 336/83
See application file for complete search history.

(56) References Cited

U.S. PATENT DOCUMENTS 4,769,900 A * 9/1988 Morinaga et al. ..... 29/606
5,917,397 A * 6/1999 Sasahara ..... 336/206
6,154,112 A 11/2000 Aoba et al.
6,392,525 B1 5/2002 Kato et al.
6,393,691 B1 5/2002 Ogawa et al.
6,535,095 B2 3/2003 Aoki et al.
6,710,693 B2 * 3/2004 Matsumoto et al. ..... 336/110
6,747,538 B2 6/2004 Kuwata et al.
6,768,409 B2 * 7/2004 Inoue et al. ..... 336/200
6,825,746 B2 11/2004 Otsuka et al.
6,864,774 B2 3/2005 Kanetaka et al.
6,927,658 B2 * 8/2005 Okamoto ..... 336/65
7,071,803 B2 * 7/2006 Oki ..... 336/83
7,183,886 B2 2/2007 Ooki
7,209,022 B2 * 4/2007 Kuroiwa et al. ..... 336/83
7,310,871 B2 12/2007 Kuroiwa et al.
7,495,538 B2 2/2009 Tsunemi et al.
7,898,375 B2 * 3/2011 Kitajima et al. ..... 336/83
2001/0038327 A1 11/2001 Aoki et al.
2004/0168303 A1 * 9/2004 Matsumoto et al. ..... 29/607
2005/0168312 A1 * 8/2005 Mandler ..... 336/83
2007/0146110 A1 6/2007 Oki

FOREIGN PATENT DOCUMENTS

CN 1637964 7/2005

(Continued)

*Primary Examiner* — Anh Mai
*Assistant Examiner* — Mangtin Lian
(74) *Attorney, Agent, or Firm* — Oliff & Berridge, PLC

(57) ABSTRACT

A coil component comprises: a core having a winding core portion, and a first flange and a second flange arranged at both ends of the winding core portion; a winding arranged in a region flanked by the first and second flanges, and wound so as to be in contact with the winding core portion; and a cover portion arranged in a region flanked by the first and second flanges, so as to cover the winding. The cover portion has a first cover portion comprising a resin cured product containing a magnetic material; and a second cover portion comprising a non-magnetic material. The second cover portion is interposed at least between the first flange and the first cover portion.

7 Claims, 9 Drawing Sheets

FOREIGN PATENT DOCUMENTS

| | | |
|---|---|---|
| JP | U-59-044013 | 3/1984 |
| JP | A-11-067520 | 3/1999 |
| JP | A-11-067521 | 3/1999 |
| JP | A-2002-008931 | 1/2002 |
| JP | A-2002-134343 | 5/2002 |
| JP | A-2004-214371 | 7/2004 |
| JP | A-2005-135948 | 5/2005 |
| JP | A-2005-210055 | 8/2005 |

* cited by examiner

COIL COMPONENT

This is a Continuation of application Ser. No. 12/047,812 filed Mar. 13, 2008. The disclosure of the prior application is hereby incorporated by reference herein in its entirety.

BACKGROUND OF THE INVENTION

1. Field of the Invention

The present invention relates to a coil component, and more particularly to a winding-type coil component.

2. Related Background Art

Known such coil components comprise a core (so-called drum-type core) having a winding core portion and a pair of flanges arranged at both ends of the winding core portion, a winding wound on the winding core portion, and a cladding resin containing a magnetic powder, filling the space between the pair of flanges (for instance, Japanese Unexamined Patent Application Laid-open No. 2005-210055). The cladding resin containing a magnetic powder covers the winding at a position between the pair of flanges.

In the coil component described in Japanese Unexamined Patent Application Laid-open No. 2005-210055, the flux generated by the coil formed by the winding constitutes a magnetic circuit that extends from the winding core portion, via one flange, the cladding resin containing a magnetic powder, and the other flange, to return to the winding core portion. In such a magnetic circuit, the cladding resin containing a magnetic powder comes into contact with the pair of flanges. The magnetic circuit is thus is a closed magnetic circuit the entire path whereof traverses portions having magnetism. A closed magnetic circuit configuration allows achieving good inductance characteristics by keeping small the flux leaking from the magnetic circuit (leakage flux). A closed magnetic circuit, however, is problematic in that magnetic saturation is likely to occur in the circuit, impairing DC bias characteristics.

SUMMARY OF THE INVENTION

An object of the present invention is to provide a coil component that enhances DC bias characteristics while preserving good inductance characteristics.

The coil component according to the present invention comprises a core having a winding core portion, and a first flange and a second flange arranged at both ends of the winding core portion; a winding arranged in a region flanked by the first and second flanges and wound so as to be in contact with the winding core portion; and a cover portion arranged in a region flanked by the first and second flanges, so as to cover the winding, wherein the cover portion has a first cover portion comprising a resin cured product containing a magnetic material, and a second cover portion which is interposed at least between the first flange and the first cover portion and which comprises a non-magnetic material.

In the present invention, the magnetic flux generated in the coil formed by the winding passes thus through the first cover portion between the first and second flanges. This keeps hence leakage flux small, affording thus good inductance characteristics.

In the present invention, the second cover portion is interposed at least between the first flange and the first cover portion, whereby the first flange and the first cover portion do not come into contact with each other. In consequence, a magnetic gap is formed by the second cover portion. As a result, magnetic saturation is less likely to occur while DC bias characteristics are enhanced.

Preferably, the first cover portion is arranged so as to cover the winding, and the second cover portion is arranged so as to cover a face of the first flange that opposes the second flange.

To form the first cover portion arranged so as to cover the winding, a resin composition containing a magnetic material is applied to a region flanked by the first and second flanges, and then the resin composition is cured. However, part of the applied resin composition might pass through the gaps in the winding and reach a portion overlapping the winding at the mutually opposing faces of the first and second flanges. The resin composition, containing a magnetic material, and having thus reached a portion overlapping the winding at the mutually opposing faces of the first and second flanges, becomes adhered to that portion upon curing. A closed magnetic circuit forms then, since the resin cured product contains a magnetic material, impairing DC bias characteristics as a result.

Arranging the second cover portion so as to cover a face in the first flange that opposes the second flange has the effect of preventing the resin composition from adhering to the face in the first flange that opposes the second flange, even when part of the resin composition containing a magnetic material penetrates through the gaps in the winding. This makes for a further reliable enhancement of DC bias characteristics.

More preferably, the second cover portion is arranged so as to further cover a peripheral side face of the first flange. Upon application of the resin composition comprising a magnetic material, part of the resin composition may overflow beyond the region flaked by the first and second flanges and become adhered to the peripheral side face of the flanges. If the resin composition is cured in that state, a closed circuit may be formed, since the resin cured product contains a magnetic material, as described above. This may impair DC bias characteristics as a result. However, arranging the second cover portion so as to further cover the peripheral side face of the first flange prevents the resin composition from adhering to the peripheral side face of the first flange, even when part of the resin composition containing a magnetic material overflows beyond the region flanked by the first and second flanges. This makes for a further reliable enhancement of DC bias characteristics.

Preferably, the first cover portion is arranged so as to cover the winding, and the second cover portion is arranged so as to cover mutually opposing faces of the first and second flanges. In this case, as described above, the resin composition does not reach the mutually opposing faces of the first and second flanges, becoming adhered thereto, even when part of the resin composition containing a magnetic material penetrates through the gaps in the winding. This makes for a further reliable enhancement of DC bias characteristics. The mutually opposing faces of the first and second flanges are each covered by the second cover portion, and hence DC bias characteristics are further enhanced.

Preferably, the second cover portion is arranged so as to cover the winding and portions of mutually opposing faces of the first and second flanges, that are exposed beyond the winding, and the first cover portion is arranged at a region surrounded by the second cover portion. In this case, the second cover portion is arranged so as to cover the winding and portions of mutually opposing faces of the first and second flanges, that are exposed beyond the winding. As a result, no part of the resin composition containing a magnetic material penetrates through gaps in the winding during formation of the first cover portion. Therefore, the resin composition does not reach the mutually opposing faces of the first and second flanges, and does not become adhered thereto. This allows hence reliably enhancing DC bias characteristics.

More preferably, the second cover portion is arranged so as to further cover peripheral side faces of the first and second flanges. In this case, as described above, the resin composition does not become adhered to the peripheral side faces of the first and second flanges, even when part of the resin composition containing a magnetic material overflows beyond the region flanked by the first and second flanges. This makes for a further reliable enhancement of DC bias characteristics.

Preferably, the second cover portion comprises a resin cured product as the non-magnetic material. The second cover portion can be easily formed in such a case.

The present invention allows thus providing a coil component that enhances DC bias characteristics while preserving good inductance characteristics.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFFERED EMBODIMENTS

Figure 1:
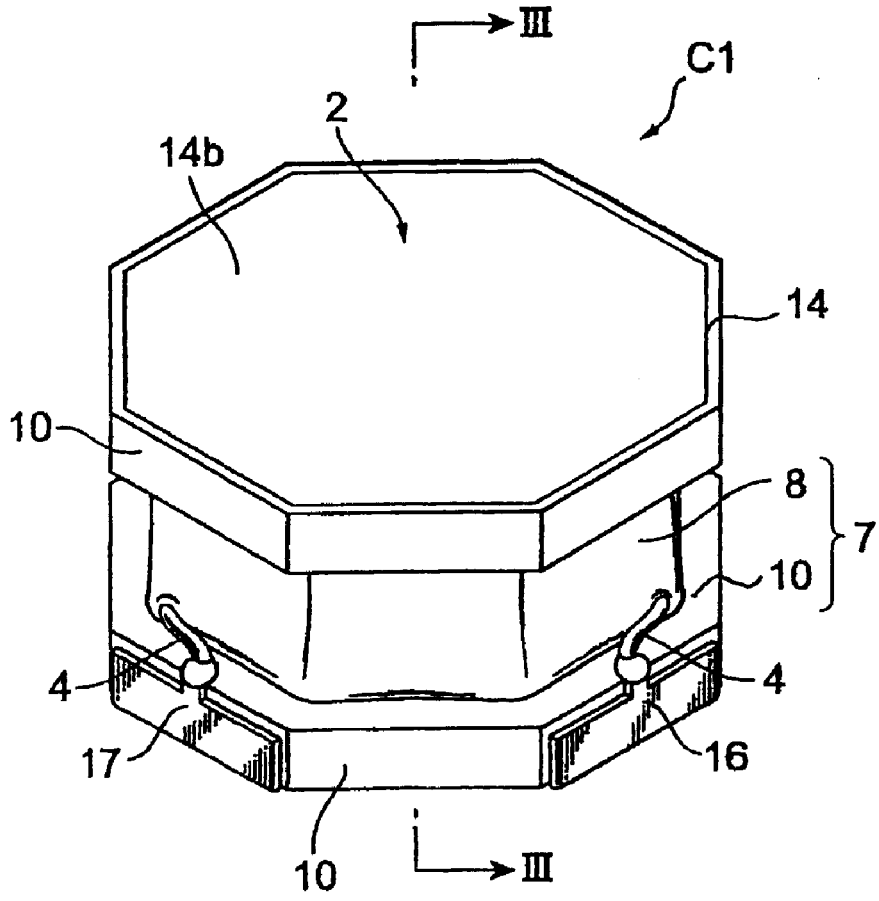
FIG. 1 is a perspective-view diagram illustrating a coil component according to an embodiment.

Preferred embodiments of the present invention are explained in detail below with reference to accompanying drawings. In the drawings, identical elements are denoted with identical reference numerals, and recurrent explanations thereof are omitted.

Figure 2:
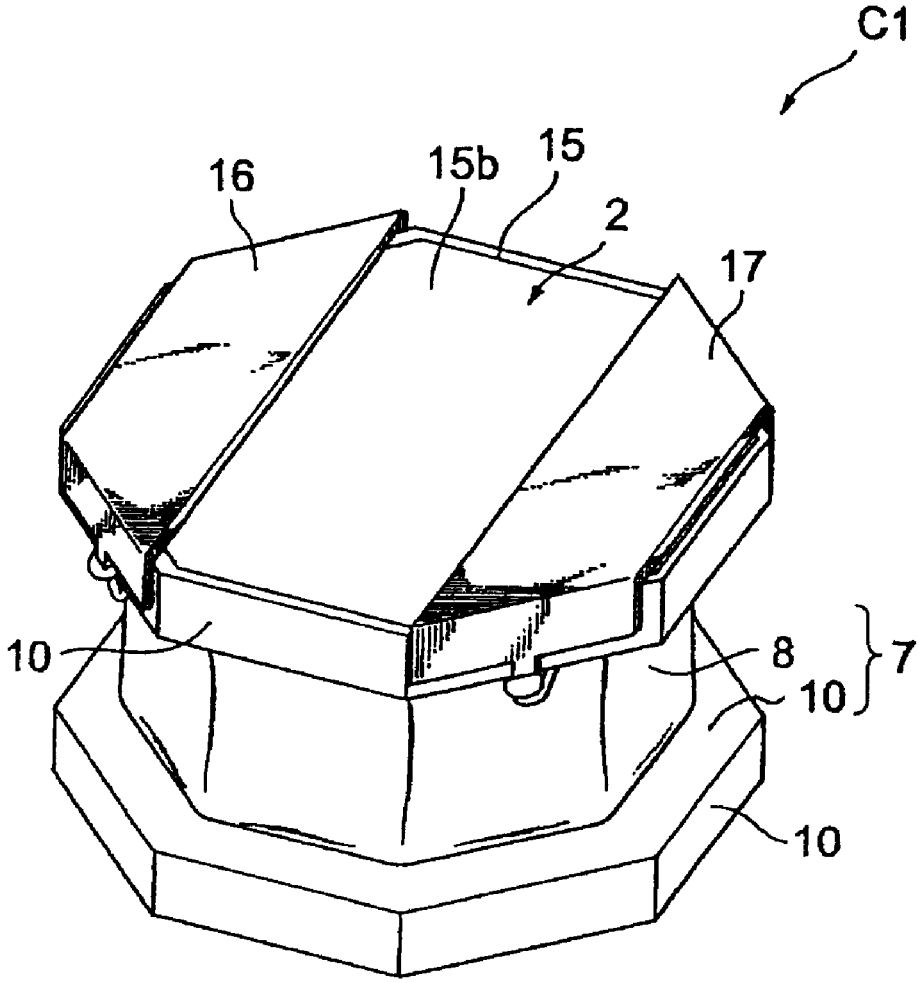
FIG. 2 is a perspective-view diagram illustrating a coil component according to the embodiment.
Figure 3:
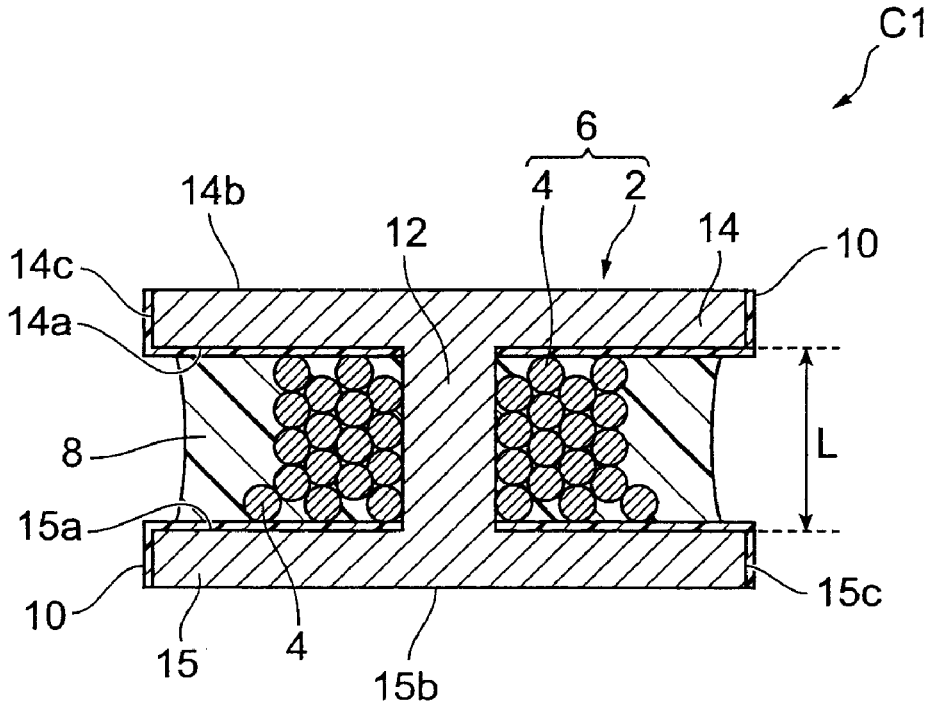
FIG. 3 is a diagram illustrating schematically the cross-sectional structure of the coil component illustrated in FIG. 1 along a III-III direction.

FIGS. 1 and 2 are perspective-view diagrams illustrating a coil component according to the present embodiment. FIG. 3 is a diagram illustrating schematically the cross-sectional structure of the coil component illustrated in FIG. 1 along the III-III direction. As shown in the figures, a coil component C1 comprises a core 2, a winding 4 and a cover portion 7.

As illustrated in FIG. 3, the core 2 has a columnar winding core portion 12, and a pair of flanges 14, 15 arranged at both ends of the axial direction of the winding core portion 12. The pair of flanges 14, 15 is shaped so that the outer periphery of the flanges protrudes out of the winding core portion 12, with the flanges arranged substantially parallel to each other. Each flange 14, 15 comprises a pair of respective principal surfaces 14*a*,14*b*,15*a*,15*b* and peripheral side faces 14*c*,15*c*. The principal surface 14*a* of the flange 14 and the principal surface 15*a* of the flange 15 oppose each other. The principal surfaces 14*b*, 15*b* of the flanges 14, 15 make up the outer surface of the core 2.

The core 2 comprises a magnetic material such as ferrite or the like. In the present embodiment, the gap between the pair of flanges 14, 15 in the core 2 (distance represented by L in FIG. 2) is 0.15 to 0.80 mm, preferably 0.15 to 0.60 mm. The outer dimensions of each flange 14, 15 (for instance, the distance between opposite sides in each flange 14, 15) is preferably no greater than 10 mm, being ordinarily of about 3 mm.

The winding 4 is wound on the winding core portion 12 of the core 2, so as to be in contact with the winding core portion 12, and is placed within a region flanked by the pair of flanges 14. The winding 4 comprises an insulation-coated metal conducting wire (for instance, a urethane wire or the like). Copper or the like is used as the metal conductor. The outer diameter of the winding 4 is, for instance, of about 0.1 mm. The winding 4 and the core 2 make up a coil portion 6.

The cover portion 7 is arranged at a region flanked by the pair of flanges 14, 15, in such a way so as to cover the winding 4. The cover portion 7 comprises a first cover portion 8 and a second cover portion 10.

The first cover portion 8 is arranged at a region flanked by the pair of flanges 14, 15, in such a way so as to cover the winding 4. That is, the first cover portion 8 is formed in between the winding core portion 12 so as to sandwich the winding 4, and is shaped in such a way so as to cover the winding 4 while in contact therewith. Preferably, the first cover portion 8 fills the gaps in the winding 4. In the present embodiment, the outer peripheral face of the first cover portion 8 is positioned at the same position of the peripheral side faces 14*c*, 15*c* of the respective flanges 14, 15, or at a position more toward the winding core portion 12 than the peripheral side faces 14*c*, 15*c*.

The first cover portion 8 comprises a resin cured product comprising a magnetic material. In the present embodiment, the first cover portion 8 comprises a resin cured product and ferrite. The content of ferrite in the first cover portion 8 is of 20 to 90 mass %, preferably of 70 to 90 mass % relative to the total mass of the resin cured product and ferrite. The density of the first cover portion 8 is 1.3 to 2.2 g/cm$^3$, preferably 1.8 to 2.1 g/cm$^3$. Examples of resin cured product constituting the first cover portion 8 include, for instance, cured products of epoxy resins, phenolic resins, polyurethane resins or polyimide resins.

The second cover portion 10 is arranged so as to cover the mutually opposing principal surfaces 14*a*, 15*a* and peripheral side faces 14*c*, 15*c* of the pair of flanges 14, 15. As a result, the second cover portion 10 is interposed between the pair of flanges 14, 15 and the first cover portion 8. In the present embodiment, the second cover portion 10 is formed over the entirety of the principal surfaces 14*a*, 15*a* and peripheral side faces 14*c*, 15*c* of the pair of flanges 14, 15.

The second cover portion 10 comprises a non-magnetic material. In the present embodiment, the second cover portion 10 comprises a resin cured product. Examples of the resin cured product constituting the second cover portion 10 include, for instance, a resin cured product of an epoxy resin or the like. The thickness of the second cover portion 10 is, for instance, 15 μm.

As illustrated in FIGS. 1 and 2, the coil component C1 further comprises a pair of terminal electrodes 16, 17. The pair of terminal electrodes 16, 17 is arranged on the flange 15, and is provided over the principal surface 15*b* and the peripheral side face 15*c* of the flange 15. The second cover portion 10 is interposed between the peripheral side face 15*c* of the flange 15 and the terminal electrodes 16, 17. The pair of terminal electrodes 16, 17, which are so-called terminal fittings, are fixed to the flange 15 by bonding, crimping or the like.

The terminal electrode 16 is connected to a first end (leadout portion) of the winding 4. The terminal electrode 17 is connected to a second end (leadout portion) of the winding 4. The ends of the winding 4 are bundled and fixed to relay portions of the opposing terminal electrodes 16, 17 by laser welding, arc welding or the like. The principal surface 15*b* of the flange 15 in the coil component C1 stands opposite the mounting face of an outer substrate or the like.

A method for manufacturing the coil component C1 having the above constitution is briefly explained next.

First, the core 2 is formed by molding, mechanical machining or the like. A resin (for instance, an epoxy resin or the like) is applied to the principal surfaces 14*a*, 15*a* and peripheral side faces 14*c*, 15*c* of the pair of flanges 14, 15 of the core 2, and then the resin is cured, to form thereby the second cover portion 10.

Next, the winding 4 is wound around the winding core portion 12 of the drum-type core 2, to form thereby the coil portion 6. The winding 4 may be wound in one direction, or in intersecting directions when plural windings are used.

Next, a resin composition is applied to the coil portion 6, in the region flanked by the pair of flanges 14, 15, in such a way so as to cover the winding 4, and then the resin is cured, to form thereby the first cover portion 8. The resin composition contains a resin (for instance, a thermosetting resin such as an epoxy resin, a phenolic resin, a polyurethane resin, a polyimide resin or the like), and ferrite.

A powdered ferrite is preferably used as the ferrite. Preferably, the ferrite is dispersed substantially homogeneously in the resin of the resin composition. The average particle diameter of the ferrite ranges appropriately from 5 to 30 μm. Suitable examples of ferrite include, for instance, ferrites having a composition such as that of Ni—Cu—Zn ferrites.

The content of ferrite in the resin composition is of 20 to 90 mass %, preferably of 70 to 90 mass %, relative to the total mass of the resin plus ferrite. A content of ferrite below 20 mass % tends to preclude achieving a sufficient enhancement effect on the inductance value of the coil component C1 as a result of adding the ferrite. When the content of ferrite exceeds 90 mass %, application of the resin composition becomes difficult on account of, for instance, excessive viscosity.

Then, the terminal electrodes 16, 17 are mounted on the core 2 (flange 15), and are joined to the ends of the winding 4 by welding. At the end of the above process there is obtained the coil component C1. The method of curing the above resins may be appropriately selected from among heating, light irradiation or the like, depending on the selected resin.

In the present embodiment, thus, the magnetic flux generated in the coil formed by the winding 4 constitutes a magnetic circuit that extends, for instance, from the winding core portion 12, via the flange 14, the second cover portion 10 arranged on the flange 14, the first cover portion 8, the second cover portion 10 arranged on the flange 15, and the flange 15, to return to the winding core portion 12. The magnetic flux generated in the coil formed by the winding 4 passes thus through the first cover portion 8 between the pair of flanges 14, 15, This keeps hence leakage flux small, affording thus good inductance characteristics.

As described above, the content of ferrite in the resin composition of the first cover portion 8 is preferably 70 to 90 mass %, relative to the total mass of the resin composition and the ferrite. Setting the content of ferrite in the resin composition to 70 to 90 mass % has the effect of increasing the effective permeability of the coil component C1 as a whole. This allows, as a result, reducing the number of turns required in the winding 4 for the coil component C1 to have a desired inductance value, while reducing as well the resistance to DC current (Rdc) of the winding 4, whereby conduction loss of the coil component C1 can be suppressed as well.

In the present embodiment, the second cover portion 10 is interposed between the pair of flanges 14, 15 and the first cover portion 8, and hence the pair of flanges 14, 15 do not come into contact with the first cover portion 8. As a result, the magnetic circuit of the flux generated by the coil formed by the winding 4 is an open magnetic circuit that traverses the second cover portion 10. That is, the second cover portion 10 is interposed between the pair of flanges 14, 15 and the first cover portion 8, so that a magnetic gap is formed by the second cover portion 10. In consequence, magnetic saturation is less likely to occur in the coil component C1, which enjoys thus enhanced DC bias characteristics.

In the present embodiment, the principal surfaces 14*a*, 15*a* of the pair of flanges 14, 15 are covered each by the second cover portion 10, which enhances further DC bias characteristics.

In the present embodiment, the second cover portion 10 is not arranged on the winding core portion 12 of the core 2, while the winding 4 is in contact with the winding core portion 12. When the second cover portion 10 is arranged on the winding core portion 12, the outer diameter of the winding core portion 12 becomes larger by the extent of the thickness of the second cover portion 10, whereupon the outer diameter of the coil formed through wrapping of the winding 4 becomes larger as well. This reduces as a result the volume of the first cover portion 8. A reduced volume of the first cover portion 8 makes it more difficult to maintain a desired inductance value. To maintain then a desired inductance value, the volume of the first cover portion 8 must thus be increased, which results in a larger outline of the coil component C1. Preferably, therefore, the second cover portion 10 is not arranged on the winding core portion 12 of the core 2, while the winding 4 is wound so as to be in contact with the winding core portion 12.

In the present embodiment, the second cover portion 10 is formed through curing of resin applied to the pair of flanges 14, 15, and comprises thus a resin cured product. The second cover portion 10 in the pair of flanges 14, 15 can thus be formed easily.

Upon application of the above-described resin composition in the region flanked by the pair of flanges 14, 15, in the manufacturing process of the coil component C1, part of the resin composition penetrates between the gaps of the winding 4. In the present embodiment, however, the second cover portion 10 is arranged so as to cover the mutually opposing principal surfaces 14*a*, 15*a* of the pair of flanges 14, 15, and hence the resin composition does not adhere to the mutually opposing principal surfaces 14*a*, 15*a* of the pair of flanges 14, 15. This allows reliably enhancing, as a result, DC bias characteristics in the coil component C1.

In the present embodiment, the second cover portion 10 is arranged so as to cover the peripheral side faces 14*c*, 15*c* of the pair of flanges 14, 15. Therefore, even if part of the resin composition overflows beyond the region flanked by the pair of flanges 14, 15 during application of the resin composition in the manufacturing process of the coil component C1, the overflowing resin composition does not become adhered to the peripheral side faces 14*c*, 15*c* of the pair of flanges 14, 15. This allows reliably enhancing, as a result, DC bias characteristics in the coil component C1.

Figure 4:
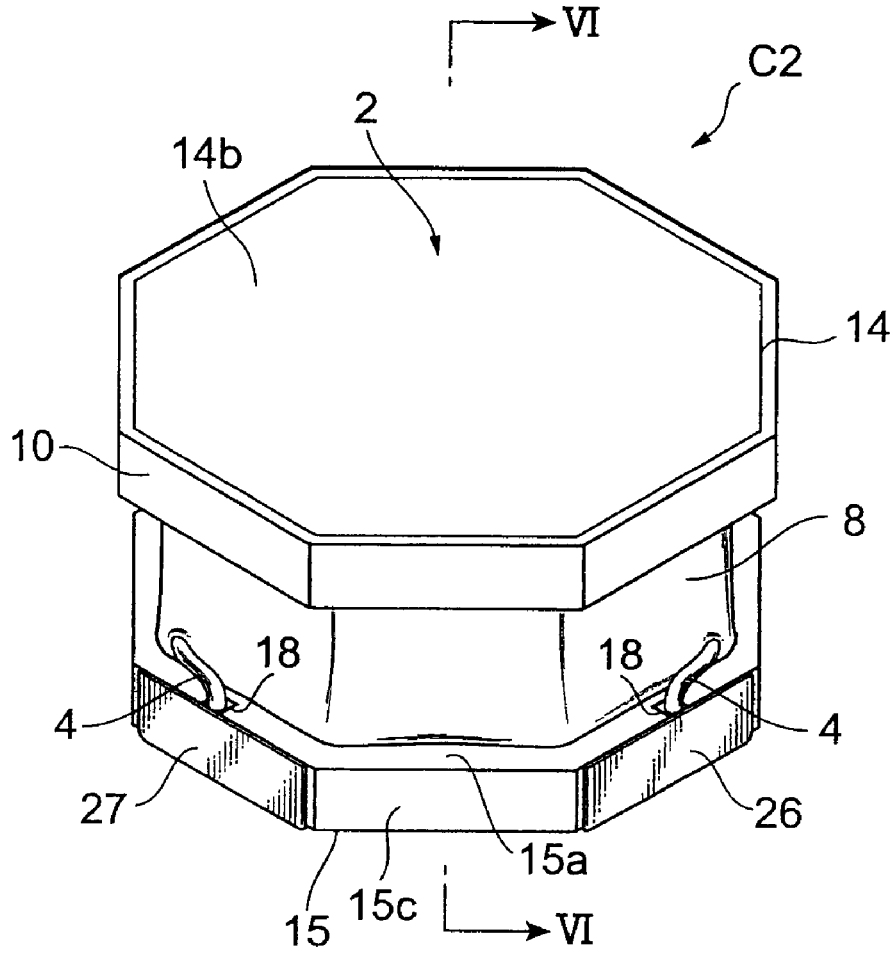
FIG. 4 is a perspective-view diagram illustrating a coil component according to a first modification of the embodiment.
Figure 5:
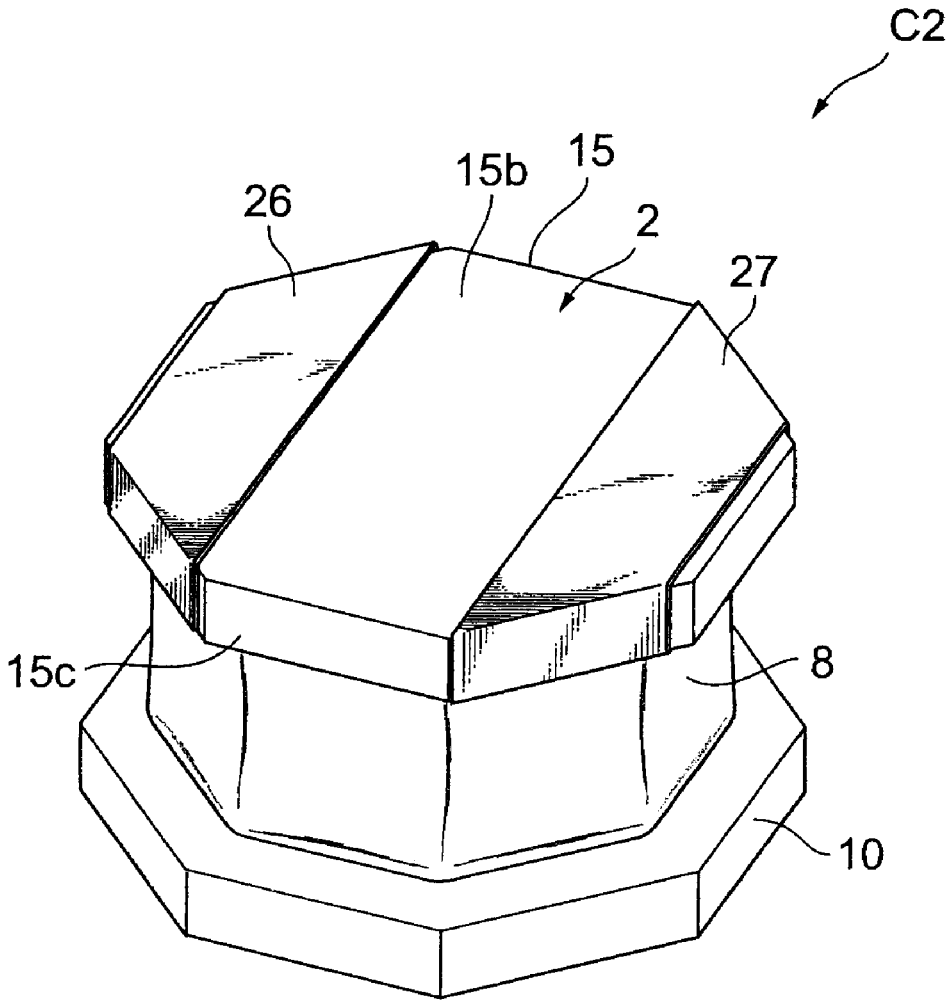
FIG. 5 is a perspective-view diagram illustrating a coil component according to the first modification of the embodiment.
Figure 6:
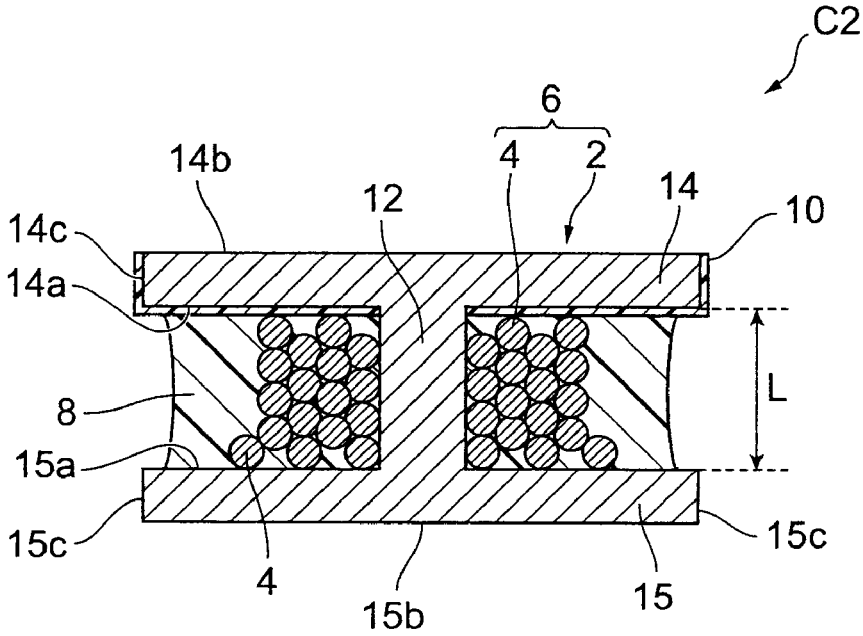
FIG. 6 is a diagram illustrating schematically the cross-sectional structure of the coil component illustrated in FIG. 4 along a VI-VI direction.
Figure 7:
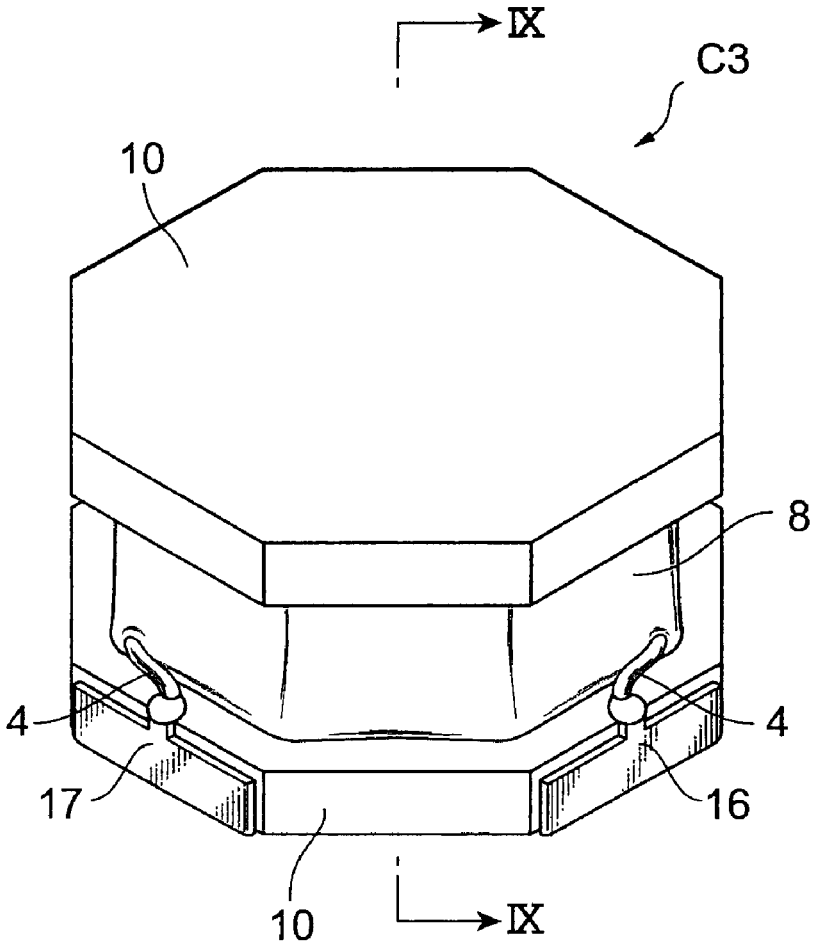
FIG. 7 is a perspective-view diagram illustrating a coil component according to a second modification of the embodiment.
Figure 8:
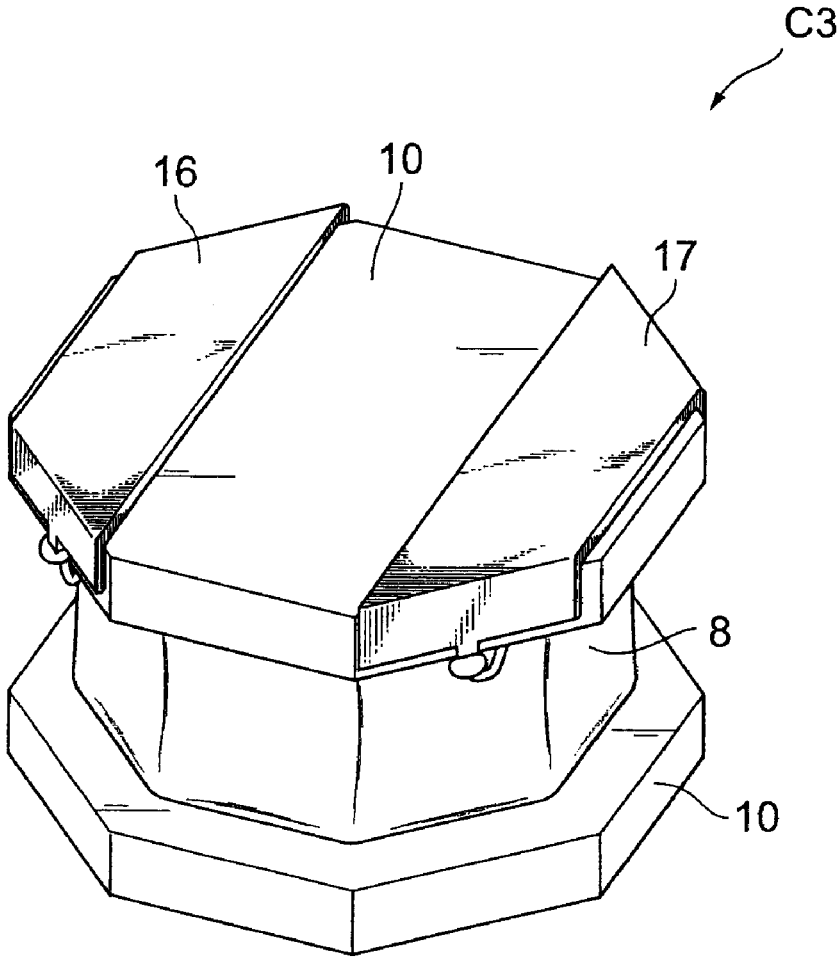
FIG. 8 is a perspective-view diagram illustrating a coil component according to the second modification of the embodiment.
Figure 9:
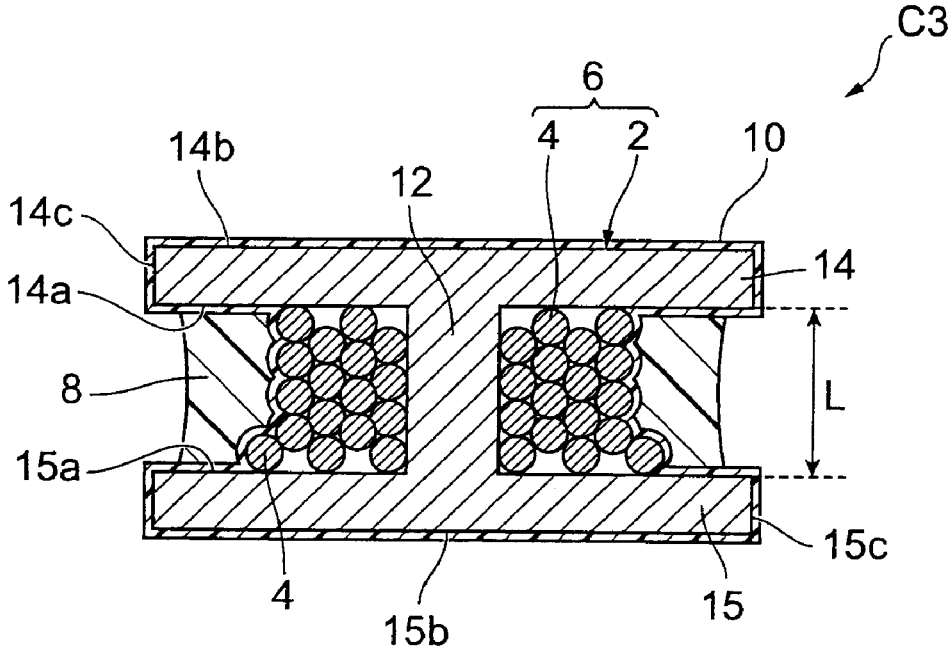
FIG. 9 is a diagram illustrating schematically the cross-sectional structure of the coil component illustrated in FIG. 7 along a IX-IX direction.

First and second modifications of the coil component C1 according to the present embodiment are explained next with reference to FIGS. 4 to 9. FIGS. 4 and 5 are perspective-view diagrams illustrating a coil component in a first modification. FIG. 6 is a diagram illustrating schematically the cross-sectional structure of the coil component illustrated in FIG. 4 along the VI-VI direction. FIGS. 7 and 8 are perspective-view diagrams illustrating a coil component in a second modification. FIG. 9 is a diagram illustrating schematically the cross-sectional structure of the coil component illustrated in FIG. 7 along the IX-IX direction.

In a coil component C2 according to the first modification illustrated in FIGS. 4 to 6, the second cover portion 10 is arranged only on the flange 14. That is, the second cover portion 10 is interposed between the flange 14 and the first cover portion 8, so that the first cover portion 8 is in contact with the flange 15. In the first modification, the second cover portion 10 is formed over the entirety of the principal surface 14*a* and the peripheral side face 14*c* of the flange 14.

In the coil component C2, grooves 18 are formed in the peripheral side face 15*c* of the flange 15, extending between the pair of principal surfaces 15*a*, 15*b*. The ends of the winding 4 are drawn up to the peripheral side face 15*c* of the flange 15 and are placed in the grooves 18, being fixed in that state to the flange 15. The end face of the winding 4 (end face of the metal conductor wire) is exposed at the principal surface 15*b*. Fixing of the winding 4 and the flange 15 can be easily carried out using cement wire as the winding 4.

As illustrated in FIGS. 4 and 5, the coil component C2 further comprises a pair of terminal electrodes 26, 27. The pair of terminal electrodes 26, 27 is arranged on the flange 15, and is provided over the principal surface 15*b* and the peripheral side face 15*c* of the flange 15. The pair of terminal electrodes 26, 27 is formed by known plating methods. The grooves 18 and the portion of the winding 4 housed in the grooves 18 are covered by the terminal electrodes 26, 27. Therefore, the winding 4 and the terminal electrodes 26, 27 are connected by forming the terminal electrodes 26, 27 on the principal surface 15*b* and the peripheral side face 15*c* of the flange 15.

A method for manufacturing the coil component C2 having the above constitution is briefly explained next.

First, the core 2 is formed by molding, mechanical machining or the like. A resin is applied next to the principal surface 14*a* and peripheral side face 14*c* of the flange 14 of the core 2, and is cured, to form thereby the second cover portion 10.

Next, the winding 4 is wound around the winding core portion 12 of the core 2. The ends of the winding 4 are housed in the grooves 18 of the flange 15, to be fixed to the flange 15.

Next, a resin composition is applied to the coil portion 6, in the region flanked by the pair of flanges 14, 15, in such a way so as to cover the winding 4, and then the resin is cured, to form thereby the first cover portion 8. Then, the terminal electrodes 26, 27 are formed on the flange 15 by plating. At the end of the above process there is obtained the coil component C2 of the first modification.

In the first modification, thus, the magnetic flux generated in the coil formed by the winding 4 constitutes a magnetic circuit that extends, for instance, from the winding core portion 12, via the flange 14, the second cover portion 10 arranged on the flange 14, the first cover portion 8, and the flange 15, to return to the winding core portion 12. The magnetic flux generated in the coil formed by the winding 4 passes thus through the first cover portion 8 between the pair of flanges 14, 15. This keeps hence leakage flux small, affording thus good inductance characteristics.

That is, in the first modification, the second cover portion 10 is interposed between the flange 14 and the first cover portion 8, so that the flange 14 does not come into contact with the first cover portion 8. As a result, the magnetic circuit of the flux generated by the coil formed by the winding 4 is an open magnetic circuit that traverses the second cover portion 10. That is, the second cover portion 10 is interposed between the flange 14 and the first cover portion 8, so that a magnetic gap is formed by the second cover portion 10. In consequence, magnetic saturation is less likely to occur in the coil component C2, which enjoys thus enhanced DC bias characteristics.

In the first modification, the second cover portion 10 is arranged so as to cover the principal surface 14*a* of the flange 14. In a manufacturing process of the coil component C2, therefore, the resin composition does not adhere to the principal surface 14*a* of the flange 14 even when part of the resin composition applied in the region flanked by the pair of flanges 14, 15 penetrates through gaps in the winding 4. This allows reliably enhancing, as a result, DC bias characteristics in the coil component C2.

In the first modification, the second cover portion 10 is arranged so as to cover the peripheral side face 14*c* of the flange 14. Therefore, even if part of the resin composition overflows beyond the region flanked by the pair of flanges 14, 15 during application of the resin composition in the manufacturing process of the coil component C2, the overflowing resin composition does not become adhered to the peripheral side face 14*c* of the pair of flange 14. This allows reliably enhancing, as a result, DC bias characteristics in the coil component C2.

In a coil component C3 according to a second modification illustrated in FIGS. 7 to 9, the second cover portion 10 is formed over the entirety of the coil portion 6 comprising the winding 4 and the core 2. That is, the second cover portion 10 is arranged so as to cover the portions of the principal surfaces 14*a*, 15*a* of the pair of flanges 14, 15 that are exposed beyond the winding 4, the peripheral side faces 14*c*, 15*c* of the pair of flanges 14, 15, as well as the winding 4. The first cover portion 8 is arranged at a region surrounded by the second cover portion 10. The second cover portion 10 is arranged so as to cover the principal surfaces 14*b*, 15*b* of the pair of flanges 14, 15.

A method for manufacturing the coil component C3 having the above constitution is briefly explained next.

First, the core 2 is formed by molding, mechanical machining or the like. Next, the winding 4 is wound around the winding core portion 12 of the core 2, to form thereby the coil portion 6.

Next, a resin is applied to the entirety of the coil portion 6 (excluding the ends of the winding 4), and is cured to form thereby the second cover portion 10. A resin composition is subsequently applied to the coil portion 6 having formed thereon the second cover portion 10, in the region flanked by the pair of flanges 14, 15, and then the resin is cured to form thereby first second cover portion 8.

Then, the terminal electrodes 16, 17 are mounted on the core 2 (flange 15), and are joined to the ends of the winding 4 by welding. At the end of the above process there is obtained the coil component C3.

In the second modification, thus, the magnetic flux generated in the coil formed by the winding 4 constitutes a magnetic circuit that extends, for instance, from the winding core portion 12, via the flange 14, the second cover portion 10 arranged on the flange 14, the first cover portion 8, the second cover portion 10 arranged on the flange 15, and the flange 15, to return to the winding core portion 12. The magnetic flux generated in the coil formed by the winding 4 passes thus through the first cover portion 8 between the pair of flanges 14, 15. This keeps hence leakage flux small, affording thus good inductance characteristics.

In the second modification also, the second cover portion 10 is interposed between the pair of flanges 14, 15 and the first cover portion 8, and hence the flanges 14, 15 do not come into contact with the first cover portion 8. As a result, the magnetic circuit of the flux generated by the coil formed by the winding 4 is an open magnetic circuit that traverses the second cover portion 10. In consequence, magnetic saturation is less likely to occur in the coil component C3, which enjoys thus enhanced DC bias characteristics, as described above.

In the coil component C3, the entirety of the coil portion 6 is covered by the second cover portion 10, and hence the resin composition does not become adhered to the core 2. This makes for a further reliable enhancement of DC bias characteristics.

The preferred embodiments explained above are not meant to limit the invention in any way. Various modifications of the above-described embodiments are possible without departing from the spirit and scope of the invention.

In the first modification, the second cover portion 10 is arranged on the flange 14, but is not limited thereto, and may be arranged on the flange 15 instead of the flange 14.

In the embodiments and the modifications, the second cover portion 10 is arranged so as to cover not only the principal surfaces 14*a*, 15*a* but also the peripheral side faces 14*c*, 15*c* of the flanges 14, 15. The second cover portion 10, however, is not limited to such an arrangement. The second cover portion 10 need only be arranged so as to cover at least one principal surface among the principal surface 14*a* and the principal surface 15*a*. Also, the second cover portion 10 need not necessarily be formed over the entirety of the principal surfaces 14*a*, 15*a* of the flanges 14, 15. The second cover portion 10 may be formed on part of the principal surfaces 14*a*, 15*a* of the flanges 14, 15 so long as the second cover portion 10 is interposed between the first cover portion 8 and the flanges 14, 15 and that the first cover portion 8 does not come into contact with the flanges 14, 15.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A coil component, comprising:

a core having a winding core portion, and a first flange and a second flange arranged at both ends of said winding core portion, the winding core portion, the first flange, and the second flange are simultaneously formed using the same material;

a winding arranged in a region flanked by the first and second flanges, and wound so as to be in contact with the winding core portion;

a cover portion arranged in a region flanked by the first and second flanges, so as to cover the winding; and a pair of terminal electrodes arranged on the first flange and provided over a principal surface and a peripheral side face of the first flange, wherein the cover portion has a first cover portion containing a magnetic material and a second cover portion not containing a magnetic material, the first cover portion is in contact with the winding and is arranged away from the first flange, the second cover portion is arranged between the first flange and the first cover portion, the second cover portion is arranged so as to cover a face of the first flange that opposes the second flange and the peripheral side face of the first flange, the second cover portion is interposed between the peripheral side face of the first flange and the terminal electrodes, and each of the winding is electrically connected to a portion arranged on the principal surface of the corresponding terminal electrode via a portion arranged on the peripheral side face of the corresponding terminal electrode.

2. The coil component according to claim 1, wherein the first cover portion is arranged so as to cover the winding.

3. The coil component according to claim 1, wherein the first cover portion is arranged away from the second flange, wherein the second cover portion is arranged between the second flange and the first cover portion.

4. The coil component according to claim 3, wherein the first cover portion is arranged so as to cover the winding; and wherein the second cover portion is arranged so as to cover mutually opposing faces of the first and second flanges.

5. The coil component according to claim 4, wherein the second cover portion is arranged so as to further cover peripheral side faces of the first and second flanges.

6. The coil component according to claim 1, wherein the first cover portion comprises a resin cured product containing the magnetic material.

7. The coil component according to claim 1, wherein the second cover portion comprises a resin cured product not containing the magnetic material.

* * * * *